United States Patent [19]

Bättig

[11] Patent Number: 4,648,537

[45] Date of Patent: Mar. 10, 1987

[54] DISPENSER CARTON WITH DUAL INTERDIGITATING CUTTING EDGES

[75] Inventor: Johann R. Bättig, Thalwil, Switzerland

[73] Assignee: The Dow Chemical Company, Midland, Mich.

[21] Appl. No.: 778,956

[22] Filed: Sep. 23, 1985

[51] Int. Cl.[4] ..... B65D 85/671

[52] U.S. Cl. ..... 225/43; 225/48; 225/91

[58] Field of Search ..... 225/48, 49, , 50, 43, 225/91

[56] References Cited

U.S. PATENT DOCUMENTS

| | | | |
|---|---|---|---|
| 2,710,152 | 6/1955 | Jones | 225/38 X |
| 3,229,875 | 1/1966 | Stoller | 225/38 |
| 4,346,838 | 8/1982 | Hauser | 225/49 |
| 4,371,104 | 2/1983 | Korte | 225/48 |
| 4,549,689 | 10/1985 | Bailey | 225/50 X |

*Primary Examiner*—Frank T. Yost

*Attorney, Agent, or Firm*—R. B. Ingraham

[57] ABSTRACT

A film dispensing carton particularly suited for consumer use has affixed projecting teeth at the bottom thereof and projecting teeth on the edge of the formable cover. When the cover is in the closed position, the teeth of the bottom and the cover intermesh and aid in cutting the film.

7 Claims, 8 Drawing Figures

Fig. 3
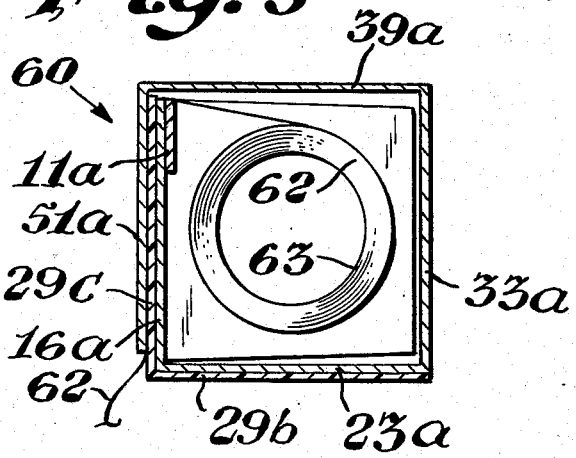
Fig. 4
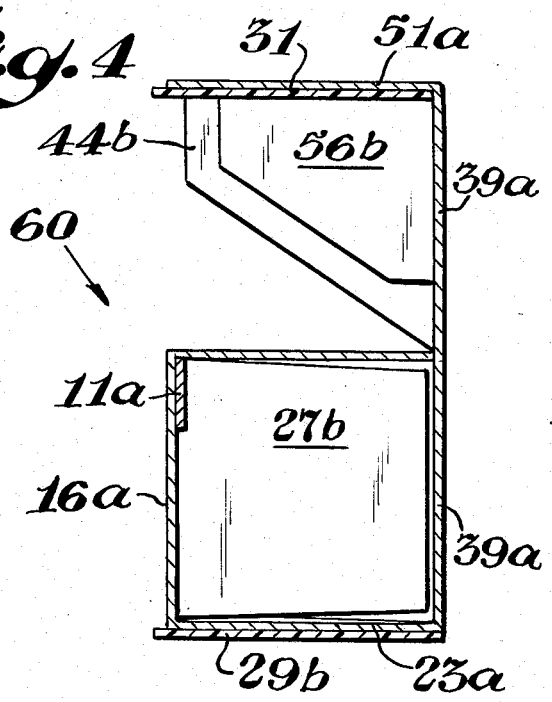
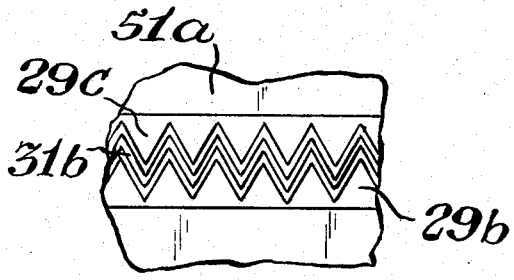
Fig. 5
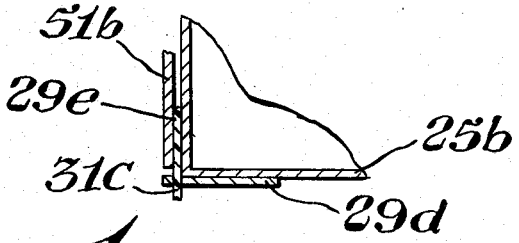
Fig. 6
Fig. 8
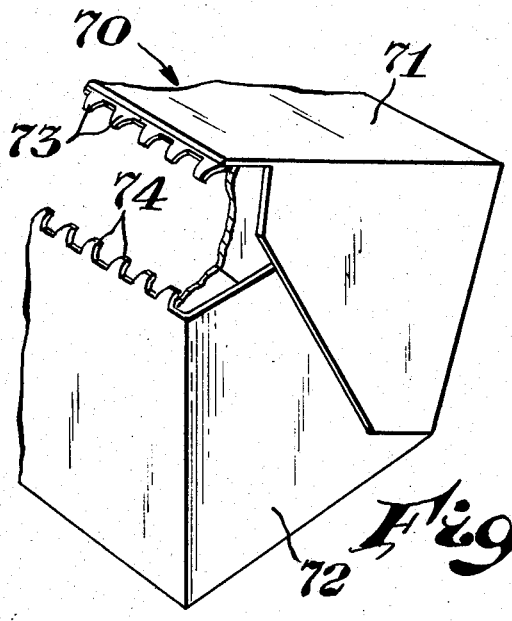
Fig. 7
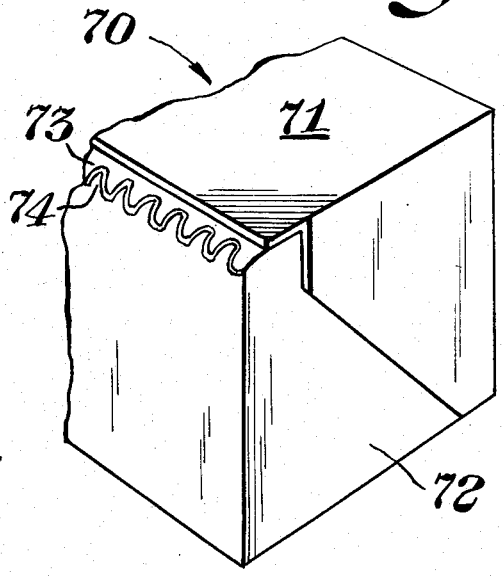

DISPENSER CARTON WITH DUAL INTERDIGITATING CUTTING EDGES

The present invention relates to a box or carton for retaining or dispensing sheets of desired length from a roll contained within the carton. The invention basically relates to a novel blank for the formation of a desirable sheet dispensing carton and an improved cutting arrangement for sheets dispensed from the carton. Sheet dispensing cartons usually comprise an elongated quadrilateral prismatic enclosure having a lid or hood which optionally may be in an open or closed position. Generally, such cartons when in the closed position provide a cutting edge fastened to a front wall, to a bottom or to a hood or cover which permits the sheet material being dispensed to be brought into contact with a serrated cutting edge and on forcing the film or sheet against the cutting edge, hopefully, reasonably straight severed edges may be obtained on the application of appropriate force on the web being dispensed.

Generally most such dispensing cartons presently available employ a serrated sheet metal strip affixed to an appropriate location on the dispensing carton to permit severing of the web which is dispensed. Such cartons at one time were employed almost solely for the dispensing of waxed paper and subsequently were utilized for the dispensing and severing of aluminum foil. Aluminum foil and waxed paper are relatively rigid webs that once perforated or otherwise weakened readily tear along the line of perforation or stress induced in the web by the serrated edge. Subsequently, a variety of synthetic resinous films have been introduced for both commercial and household use.

Such webs as in the case of plastic film, waxed paper and aluminum foil are wound upon a generally cylindrical spool or core positioned within the dispensing container, the spool or core having a longitudinal dimension slightly less than but approximating the longitudinal dimension of the dispensing carton. The physical properties of synthetic resinous thermoplastic films utilized for various purposes, such as overwraps, covering of open mouthed dishes, and the like, have varied widely from relatively rigid films such as polystyrene or styrene polymer films to less rigid films such as those obtained from plasticized vinylidene chloride polymers, polyethylene and the like. As the synthetic resinous films become softer, they become more difficult to tear. By the term "softer" is meant that the films exhibit a greater degree of elongation prior to breaking, and the deformation of such film is greater prior to penetration by a pointed object or a plurality of pointed objects such as is caused by the serrated metal edge on a dispensing carton. The metallic serrated edges of the dispensing cartons may be considered to be of a relatively fine tooth design, that is, for a given distance along such a cutting edge. The number of teeth may be relatively great; for example, 32 to 40 teeth per lineal inch of cutting edge.

It has been proposed as in the example in U.S. Pat. No. 4,371,104, issued Feb. 1, 1983, that the metallic serrated cutting edge or bar be replaced by a plastic, that is synthetic resinous thermoplastic serrated edge having a substantially lesser number of teeth than is generally found in metallic cutting edges. The effectiveness of any particular given cutting edge varies with the particular material being severed. Thus material such as aluminum foil, waxed paper, polystyrene film and the like are relatively easily severed in the conventional manner of pulling the web against the serrated edge to provide a desirable linear clean parting of the material. As the web or film being dispensed exhibits greater resistance to perforation by points or teeth disposed on the serrated edge of the cutting bar, substantially greater force is required to sever the film. As greater force is applied to the film, the tendency of the film to stretch and to deform increases. Therefore, for the so-called tougher or softer films, severing the web by forcing against a serrating cutting bar becomes significantly more difficult.

It is an object of this invention to provide an improved dispensing carton with cutting edges, the carton being satisfactory for the severing of a wide variety of webs dispensed from the carton.

It is also an object of the present invention to provide an improved simply constructed dispensing carton useable with a wide variety of webs to be dispensed.

It is also an object of the present invention to provide a dispensing carton which will permit by manual manipulation improved and easier cutting of webs which in the past have proved difficult to sever on conventional serrated web cutting members.

These benefits and other advantages in accordance with the present invention are achieved in a dispensing carton having a generally elongate rectangular configuration and a generally square cross sectional configuration in a plane generally normal to the longitudinal axis of the container, the container comprising in cooperative combination a front wall of rectangular configuration, the front wall having a first edge and a second edge, a first end and a second end, a first connecting flap and a second connecting flap foldably affixed to said first and second ends respectively, the second side of the front panel being foldably affixed to a bottom panel, the bottom panel having a first edge foldably affixed to the second edge of the front panel, the bottom panel having a first end and second end securing flaps affixed to first end and second end respectively of the bottom panel; the second edge of the bottom panel being foldably affixed to a back panel, the back panel having a first edge and a second edge, the first edge of the back panel being foldably affixed to the second edge of the bottom panel; the back panel having a first end and a second end, first and second securement flaps affixed to the first and second ends respectively of the back panel; a top panel hingedly affixed to the back panel, the top panel having a first side and a second side, the first side of the top panel being hingedly affixed to the second side of the back panel, the top panel having a first end and a second end with first and second securement flaps affixed to the first and second ends respectively of the top panel; the top panel having foldably affixed thereto a hood panel, the hood panel having a first side and a second side, the first side of the hood panel being foldably affixed to the second side of the top panel, the hood panel having a first end and a second end and first and second securement flaps being foldably affixed to the first and second ends of the hood panel respectively; the front and bottom panels being disposed in planes which are generally at right angles to each other, the bottom and rear panel being disposed in planes generally normal to each other with the limitation that the rear panel, front panel and bottom form a generally U-shaped configuration and the first securement tabs of the front, bottom and rear panels are affixed to one another, and the second securement flaps of the front, bottom and rear panels are affixed to one another to thereby form an open topped generally rectangular configuration; the top panel and hood panel being disposed in planes which are generally normal to each other and the first securement flaps of the top and hood panel being affixed to one another and the second securement flaps of the top and hood panel being affixed to one another, the top panel being adapted to hingedly rotate about the juncture between the rear panel and the top panel to permit positioning of the hood panel over the front panel, a first serrated cutting edge affixed to a side of the hood panel remote from the top panel; a second serrated edge member affixed to the bottom panel at a location adjacent the front panel with the further limitation that when the dispensing carton is closed by positioning the hood panel generally parallel to the front panel and covering the front panel with the hoods panel, the serrated edges of the bottom panel and the hood panel each defining a plurality of projecting teeth and said teeth interdigitating.

Also contemplated within the scope of the present invention is a blank suitable for the manufacture or preparation of a carton in accordance with the previous description.

Further features and advantages of the present invention shall become more apparent from the following specification taken in connection with the drawing wherein FIG. 1 is a view of a blank suitable for the preparation of a dispensing carton in accordance with the present invention;

FIG. 3 is a schematic cross sectional view of a closed carton generally in accordance with FIG. 2 having a roll of film or sheet-like material disposed therein;

FIG. 4 is a schematic cross sectional representation of a carton such as depicted in FIG. 2 wherein the top and hood have been raised to an open position;

FIG. 5 is a schematic fractional view depicting the intermeshing of projecting teeth of the hood and bottom panel of a carton such as depicted in FIG. 2;

FIG. 6 is a fractional sectional view of an elongate embodiment of the invention wherein the members defining the intermeshing teeth have a dimension substantially less than their associated panels;

FIG. 7 depicts a fractional isometric view of a partially open dispensing carton in accordance with the invention; and FIG. 8 depicts a fractional isometric view of the carton portion of FIG. 7 in the closed position.

Figure 1:
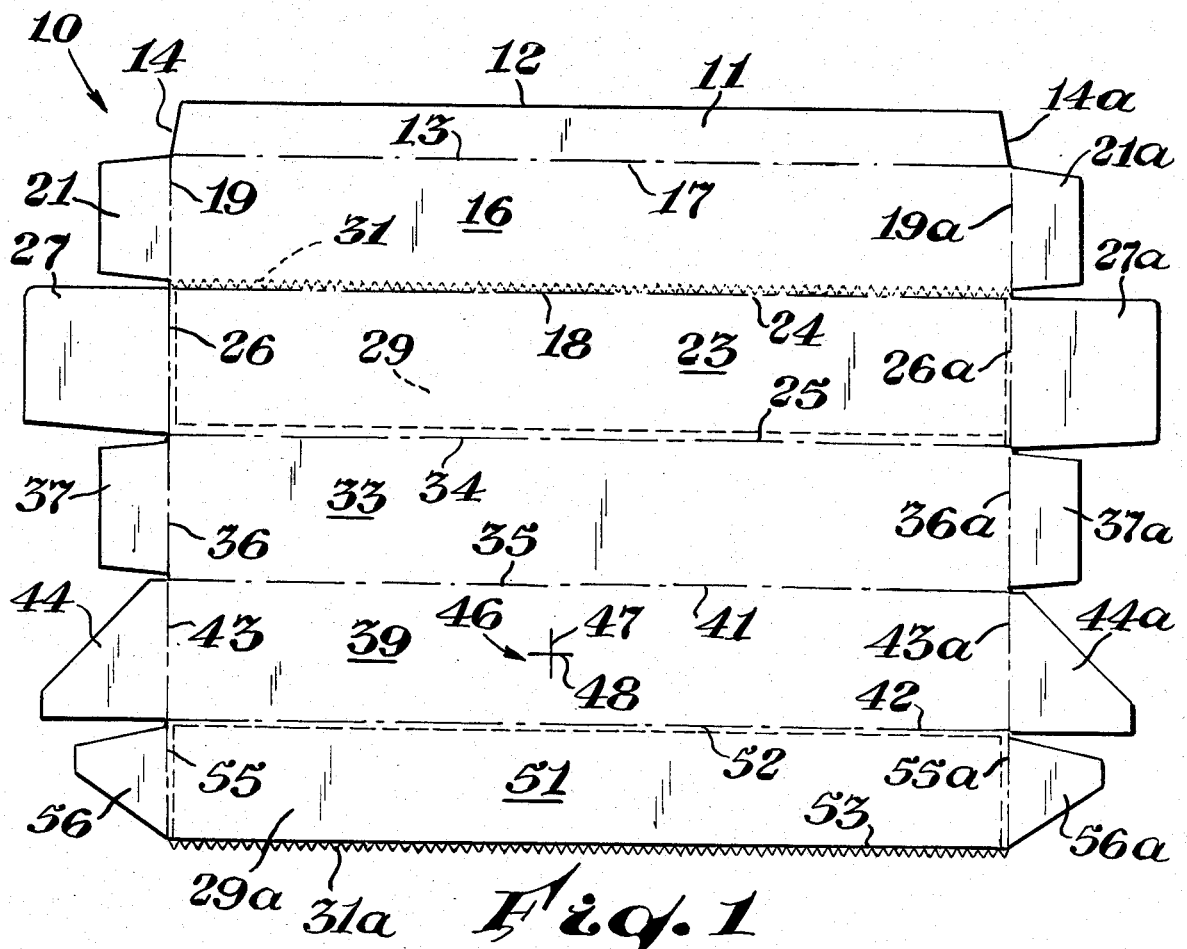

In FIG. 1 there is depicted a plan view of a carton blank in accordance with the present invention generally designated by the reference numeral 10. Beneficially the carton blank 10 is of paperboard, plastic, paperboard-plastic laminate and the like. The carton blank 10 has a first or lip panel 11. The lip panel 11 has a first side 12, a second side 13, a first end 14 and a second end 14*a*. The lip panel 11 has foldably affixed thereto a front panel 16, the front panel 16 being of generally rectangular configuration and having a first side 17 and a second side 18, the first side 17 being foldably affixed to the second side 13 of the panel 11. The front panel 16 has a first end 19 and a second end 19*a*. A securement flap 21 is foldably affixed to the first end 19 and similar securement flap 21*a* is foldably affixed to the second end 19*a*. Adjacent front panel 16 is a bottom panel 23 having a first side 24 and a second side 25. The first side 24 of the bottom panel 23 is foldably affixed to the second side 18 of the front panel 16. The bottom panel 23 has a first end 26 having affixed thereto a securement flap 27. The panel 23 has a second end 26*a* having foldably affixed thereto a second securement flap 27*a*. The bottom panel 23 has affixed thereto a bottom cutting member 29. The bottom cutting member 29 is of generally planar configuration and defines a plurality of teeth 31 which project beyond the first edge 24 of the bottom panel 23 toward first side 17 of the front panel 16.

As depicted in FIG. 1 the cutting means 29 is generally coextensive in dimension with the bottom panel 23. However, for purposes of the present invention, it is necessary that the cutting member 29 only be of sufficient width to support servicably the teeth 31 during cutting operation. A back panel 33 is disposed adjacent the bottom panel 23. The back panel 33 has a first edge 34 and a second edge 35. The first edge 34 is foldably attached to the second edge 25 of the bottom panel 23. The back panel 33 has a first end 36 having foldably attached thereto a securement flap or tab 37. The back panel 33 has a second end 36*a* having foldably attached thereto a securement tab 37*a*. Adjacent the back panel 33 is disposed a top panel 39 having a first edge 41 and a second edge 42. The first edge 41 of the top panel 39 is foldably affixed to the second edge 35 of the back panel 33. The top panel 39 has a first end 43 having foldably attached thereto a securement flap 44. The panel 39 has a second end 43*a* having foldably attached thereto a securement flap 44*a*. A finger depressible means 46 is generally centrally disposed within a top panel 39 and as depicted in FIG. 1 comprises a pair of crossed slots 47 and 48 which extend generally at right angles to each other and intersect at the centers thereof.

A hood panel 51 is disposed adjacent the top panel 39. The hood panel 51 has a first side 52 and a second side 53. The first side 52 of the hood panel 51 is foldably affixed to the second side 42 of the top panel 39. The hood panel 51 has a first end 55 having foldably affixed thereto a securement flap 56. The panel 51 has a second end 55*a* having foldably affixed thereto a second end 56*a* having foldably affixed thereto a second end securement flap 56*a*. Affixed to the hood panel 51 is a second cutter edge defining means 29*a* defining a plurality of teeth 31*a* extending beyond the edge 53 of the hood panel 51 in a direction away from first edge 52 of hood panel 51. The cutting edge defining means 29*a* as shown in FIG. 1 is affixed beneath or outside panel 51, however, optionally, this means 29*a* is affixed to the upper surface of panel 51 of FIG. 1. The projecting teeth 31*a* have a like frequency to the teeth 31 of the cutter means 29, but, however, are displaced 180° or one-half of the width between cutter teeth relative to the teeth 31 to thereby cause intermeshing of the teeth 31 and 31*a* when the blank 10 is folded into a carton.

In forming a carton from a blank such as the blank 10 of FIG. 1, the lip panel 11 is folded up and out of the plane of the paper along the fold line designated by the reference numbers 13 and 17 representing edges of the panels 11 and 16 respectively. Such a fold desirably is about 180° and affixed to panel 16 thereby providing reinforcement and a smooth dispensing edge. The securement flaps 21 and 21*a*, 27 and 27*a* are folded upwardly about 90° and the front panel folded upwardly about 90° along the second edge 18 of the panel 16, and the first edge 24 of the panel 23. The securement flaps 37 and 37*a* are folded upward and out of the plane of the paper a about 90° and the rear panel 33 folded at about 90° about the second edge 25 of the panel 23 and the first edge 34 of the back panel 33. The flaps 21, 27 and 37 are affixed in a manner which is aesthetically suitable. Similarly the flaps 21*a*, 27*a* and 37*a* are also joined together. Advantageously, such flaps are secured by means of adhesive or other suitable fastening means to provide a roughly rectangular trough. Subsequently or simultaneously the securement flaps 44, 56, 44*a* and 56*a* are folded upwardly at about 90°. The top panel and hood panel folded at about 90° about the second edge 42 of the panel 39 and the first edge 52 of the hood panel 51. The panels 44 and 56 are secured together to maintain the hood panel 51 and top panel 39 at about 90°. Similarly, securement flaps 44*a* and 56*a* are affixed to each other to maintain about a 90° angle between the top panel 39 and the hood panel 51. The back panel 33 and top panel 39 are folded about the juncture of the second edge 35 of the back panel 33 and first edge 41 of the top panel 39 to provide a closed rectangular dispensing carton generally as schematically isometricly as depicted in FIG. 2 and designated by the reference numeral 60.

Figure 2:
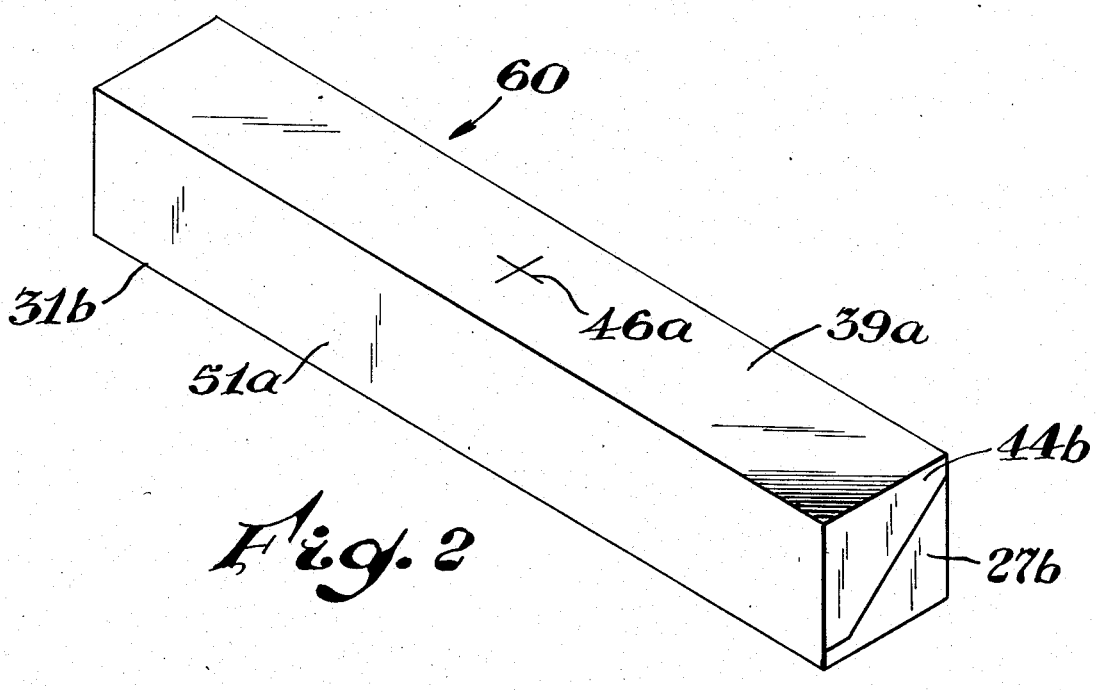
FIG. 2 is a schematic isometric view of a dispensing carton assembled from a blank such as depicted in FIG. 1.

As shown in FIG. 2, a generally vertically extending hood panel 51*a* is affixed at about in right angle relationship to a top panel 39*a* of the carton 60. Visible at the terminal end of the carton is a securement flap 44*b* and partially shown is a securement flap 27*b*. Disposed in the top panel 39*a* is a finger depressible means 46*a*. The finger depressible means 46*a* is pressed with a finger to frictionally engage a roll of sheet or film within the carton and thereby prevent rotation of the roll and assure that additional sheet or film is not withdrawn from the carton. Tooth defining members not shown define teeth equivalent to the teeth 31 and 31*a* which form a longitudinal row of interidgitated teeth designated by the reference numeral 31*b*.

FIG. 3 depicts a cross sectional view of a dispensing carton such as the carton 60 of FIG. 2 disclosing the relationship between the top panel 39*a*, a hood panel 51*a*, a front panel 16*a* having a lip panel 11*a* affixed thereto; together with a bottom panel 23*a* and associated cutting means 29*b*; a cutting means 29*c* is affixed to the hood panel 51*a*. A rear panel 33*a* connects the top panel 39*a* with the bottom panel 23*a*. Disposed within the carton 60 is a roll 62 of film or sheet supported on a generally cylindrical core or spool 63. An unwound portion of the film roll 62*a* extends from the roll 62 over lip panel 11*a* toward the juncture of the cutting means 29*b* and 23*c* at the juncture of the bottom panel 23*a* and the front panel 16*a*.

FIG. 4 shows a sectional view of the carton 60 with the roll 62 removed and the carton 60 in the open position without the roll 62. Like numbers designate like members.

In FIG. 5 there is a schematic fractional view of a carton such as the carton 60 of FIG. 2 showing intermeshing or interdigitated teeth 31*b* supported by hood panel 51*a* and the toothed segment 29*b* supported by bottom panel 23*a* not shown.

FIG. 6 depicts a fractional cross sectional view of intermeshing or interdigitated teeth depicted by the reference numeral 31*b*, the intermeshing teeth 21*b* comprising the first set of teeth 29*d* supported by a bottom panel 23*b* and a hood panel 51*b* supporting a second toothed member 29*e*. The tooth carrying members 29*d* and 29*e* as depicted in FIG. 6 are of substantially lesser width than their associated supporting panels.

In FIGS. 1–5, it has been assumed that the front, bottom, back, top and hood panels are generally of like dimension.

In FIG. 7, there is depicted a fractional isometric view of a carton in accordance with the present invention generally designated by the reference numeral 70. The carton 70 has a hood portion 71 hingedly affixed to a generally hollow box-like structure or portion 72 generally as depicted in FIGS. 2, 3, and 4. The hood portion supports a first set of teeth generally designated by the reference numeral 73 while the box-like portion supports a second set of teeth generally designated by the reference numeral 74. The teeth 73 and 74 are inwardly curving relative to space enclosed by the carton 70 and hood portion 71.

The function of the curved teeth becomes more readily apparent from the fractional isometric view of FIG. 8, wherein the carton 70 is depicted in the closed position, wherein the hood 71 has moved the tooth series 73 toward the tooth series 74 and caused interdigitation thereof. The combination of the tooth series 73 and 74 provides enhanced perforation of a film disposed therebetween, the film not shown.

Carton blanks in accordance with the present invention are readily utilized to prepare film and sheet dispensing cartons for making improved perforation of such film and sheet and subsequently substantially reducing the effort required to sever film from a dispensing roll contained within a carton.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A dispensing carton having a generally elongate rectangular configuration and a generally square cross sectional configuration in a plane generally normal to the longitudinal axis of the container, the container comprising in cooperative combination a front wall of rectangular configuration, the front wall having a first edge and a second edge, a first end and a second end, a first connecting flap and a second connecting flap foldably affixed to said first and second ends respectively, the second side of the front panel being foldably affixed to a bottom panel, the bottom panel having a first edge foldably affixed to the second edge of the front panel, the bottom panel having a first end and second end securing flaps affixed to first end and second end respectively of the bottom panel; the second edge of the bottom panel being foldably affixed to a back panel, the back panel having a first edge and a second edge, the first edge of the back panel being foldably affixed to the second edge of the bottom panel; the back panel having a first end and a second end, first and second securement flaps affixed to the first and second ends respectively of the back panel; a top panel hingedly affixed to the back panel, the top panel having a first side and a second side, the first side of the top panel being hingedly affixed to the second side of the back panel, the top panel having a first end and a second end with first and second securement flaps affixed to the first and second ends respectively of the top panel; the top panel having foldably affixed thereto a hood panel, the hood panel having a first side and a second side, the first side of the hood panel being foldably affixed to the second side of the top panel, the hood panel having a first end and a second end and first and second securement flaps being foldably affixed to the first and second ends of the hood panel respectively; the front and bottom panels being disposed in planes which are generally at right angles to each other, the bottom and rear panel being disposed in planes generally normal to each other with the limitation that the rear panel, front panel and bottom form a generally U-shaped configuration and the first securement tabs of the front, bottom and rear panels are affixed to one another, and the second securement flaps of the front, bottom and rear panels are affixed to one another to thereby form an open topped generally rectangular configuration; the top panel and hood panel being disposed in planes which are generally normal to each other and the first securement flaps of the top and hood panel being affixed to one another and the second securement flaps of the top and hood panel being affixed to one another, the top panel being adapted to hingedly rotate about the juncture between the rear panel and the top panel to permit positioning of the hood panel over the front panel, a first serrated cutting edge affixed to a side of the hood panel remote from the top panel; a second serrated edge member affixed to the bottom panel at a location adjacent the front panel with the further limitation that when the dispensing carton is closed by positioning the hood panel generally parallel to the front panel and covering the front panel with the hood panel, the serrated edges of the bottom panel and the hood panel each defining a plurality of projecting teeth and said teeth interdigitating.

2. The carton of claim 1 wherein the first serrated cutting edge is generally commensurate with the side of the hood panel and the second serrated edge member is generally commensurate with the bottom panel.

3. The carton of claim 1 wherein the first and second cutting edges are substantially narrower than the panels to which they are affixed.

4. The carton of claim 1 wherein the panels and flaps are of paperboard.

5. The carton of claim 1 wherein the panels and flaps are of plastic material.

6. The carton of claim 1 wherein the panels and flaps are of a paper/plastic laminate.

7. The carton of claim 1 wherein the top panel defines a finger depressible means whereby pressure may be applied to a roll of film or sheet-like material within the carton to prevent rotation thereof.

* * * * *